United States Patent [19]

Miyakawa

[11] Patent Number: 4,611,546

[45] Date of Patent: Sep. 16, 1986

[54] APPARATUS FOR ATTACHING FLY STRIPS TO A SLIDE FASTENER CHAIN

[75] Inventor: Kazuo Miyakawa, Marietta, Ga.

[73] Assignee: Yoshida Kogyo K. K., Tokyo, Japan

[21] Appl. No.: 643,543

[22] Filed: Aug. 23, 1984

[51] Int. Cl.[4] ..... D05B 3/12

[52] U.S. Cl. ..... 112/121.27; 112/113; 112/121.11; 112/272; 112/322

[58] Field of Search ..... 112/121.27, 318, 319, 112/322, 265.2, 272, 113, 121.11, 121.26

[56] References Cited

U.S. PATENT DOCUMENTS 3,570,104 3/1971 Jensen .

4,362,116 12/1982 Gupta et al. ..... 112/113 X 4,541,352 9/1985 Bosen et al. ..... 112/121.26 X

*Primary Examiner*—H. Hampton Hunter

*Attorney, Agent, or Firm*—Hill, Van Santen, Steadman & Simpson

[57] ABSTRACT

Successive fly strips are continuously sewn to a continuous slide fastener chain by a continuously operating sewing machine as the fly strips are supplied one after another to the sewing machine. During this supplying, a succeeding fly strip is superimposed over a preceding fly strip in a feed station while the preceding fly strip is supplied to the sewing machine and is sewn to the fastener chain. The succeeding fly strip is kept waiting by a stop in its superimposed position for supply to the sewing machine. When the trailing end of the preceding fly strip is advanced by the sewing machine from the leading end of the succeeding fly strip as the sewing of the preceding fly strip progresses, the succeeding fly strip is then supplied to the sewing station at a speed higher than the rate at which the sewing of the preceding fly strip progresses. The succeeding fly strip's leading end catches up with the preceding fly strip's trailing end by the time the latter arrives at the sewing station, so that fly strips are sewn in continuous, contiguous abutting end fashion.

18 Claims, 17 Drawing Figures

APPARATUS FOR ATTACHING FLY STRIPS TO A SLIDE FASTENER CHAIN

CROSS-REFERENCE TO RELATED APPLICATION

This application relates to the subject matter disclosed in commonly assigned Ser. No. 502,310, filed June 8, 1983; now U.S. Pat. No. 4,541,352, dated Sept. 17, 1985 and entitled "Method And Appartus For Attaching Fly Strips To A Slide Fastener Chain".

BACKGROUND OF THE INVENTION

The present invention relates to the production of trousers closures for fly openings, and more particularly to a method and apparatus for attaching successive fly strips to a continuous slide fastener chain.

U.S. Pat. No. 3,750,104 discloses a system for automatically attaching a plurality of fly strip pieces one after another to a continuous slide fastener chain. There, the fly strips are fed to an intermittently operable sewing machine one after another by means of feed rollers in timed relation to the intermittent operation of the sewing machine. A continuous length of fastener chain is continuously fed to the sewing machine for joining fastener chain to the fly strip pieces. This intermittent operation of the sewing machine is controlled by a photoelectric cell detector at the sewing station. The detector detects the completion of sewing of one fly strip when the trailing end of a sewn fly strip piece passes it to produce a "stop" signal not only to terminate the operation of the sewing machine but also to energize the feed rollers. Subsequently, the detector detects the arrival of the next fly strip when the leading end of the next fly strip piece passes it to produce a "start" signal to initiate the operation of the sewing machine. Since the sewing operation is halted repeatedly with this system, there is considerable waste of sewing machine on-time and only a limited rate of production of the trouser closures can be achieved.

The present invention represents a significant advance and improvement in efficiency over the prior art by providing a method and apparatus for sewing a succession of fly strips to a continuous slide fastener chain continuously, without interruption, whereby fly strip pieces are supplied successively to a sewing station, thus increasing the rate of production of trouser closures.

SUMMARY OF THE INVENTION

In an automated assembly, successive fly strips are able to be continuously sewn to a continuous slide fastener chain by a continuously operating sewing machine. The fly strips are supplied one after another to the sewing machine. During this supplying, a succeeding fly strip is superimposed over a preceding fly strip in a feed station. As the preceding fly strip is supplied to the sewing machine and sewn to the fastener chain, the succeeding fly strip is kept waiting, in its superimposed position, by a stop for supply to the sewing machine. When the trailing end of the preceding fly strip passes out from beneath the leading end of the succeeding fly strip as the sewing of the preceding fly strip progresses, the succeeding fly strip is forwarded to the sewing station at a speed higher than the rate at which the sewing of the preceding fly strip progresses. In accordance with the invention, the succeeding fly strip's leading end catches up with the preceding fly strip's tailing end by the time the latter arrives at the sewing machine operation.

The invention could also have similar application with other types of piecework to be sewn, individually or together with another piece such as a continuous length material. The benefits to sewing operation efficiency and improved production due to the invention are not limited to the preferred embodiment use with fly strips.

Other inventive features, objects and advantages to the present invention will become apparent to those skilled in the art from the detailed description below of a preferred embodiment.

BRIEF DESCRIPTION OF A DRAWING

Figure 8:
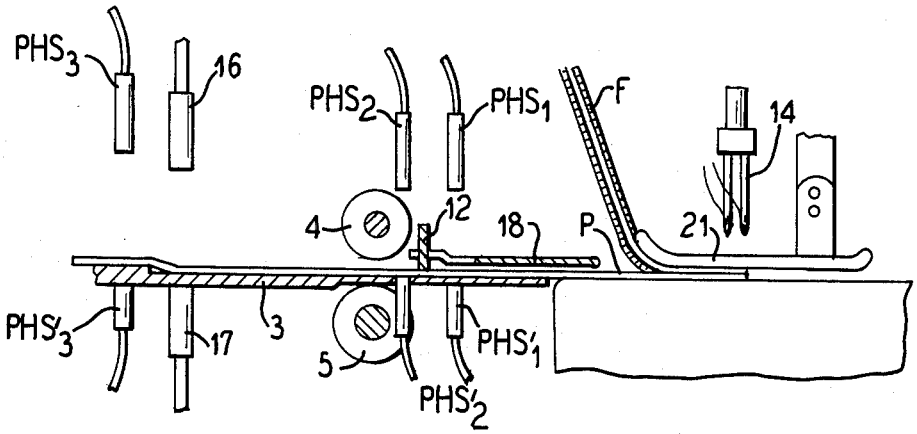
Figure 10:
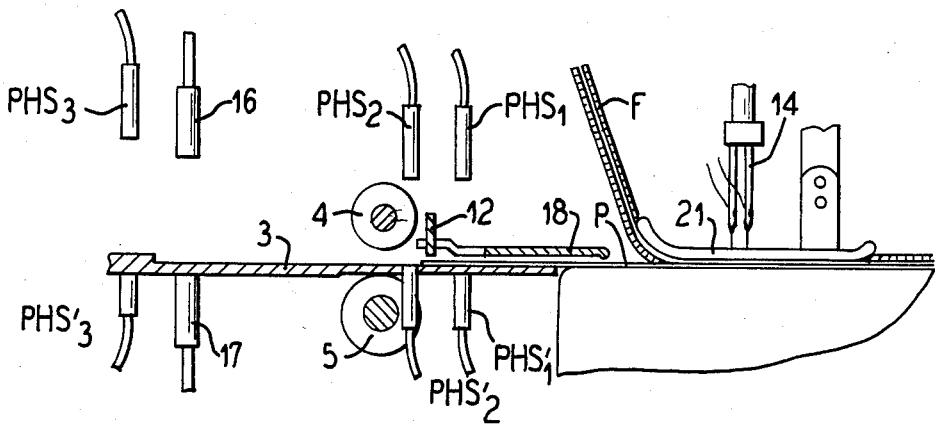
Figure 9A:
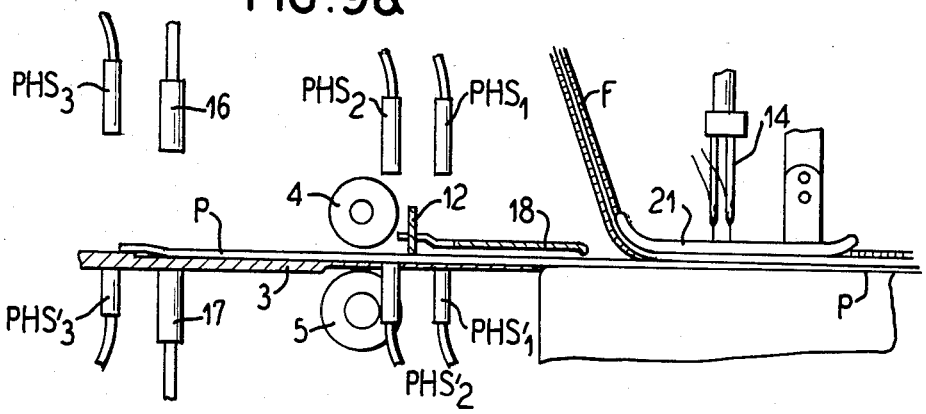
Figure 9B:
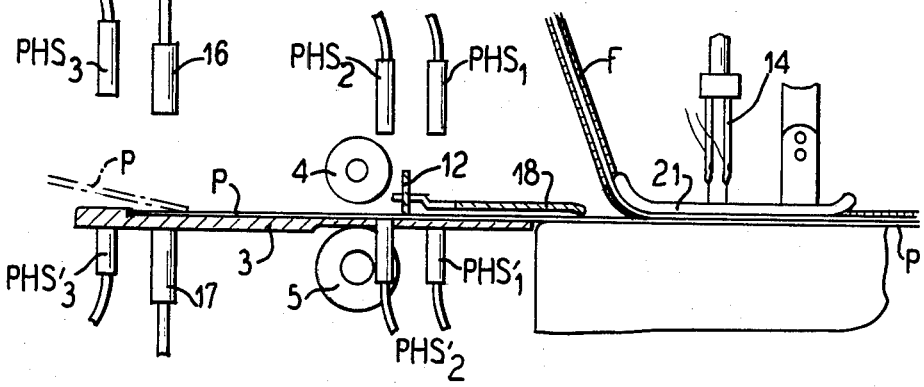
Figure 9C:
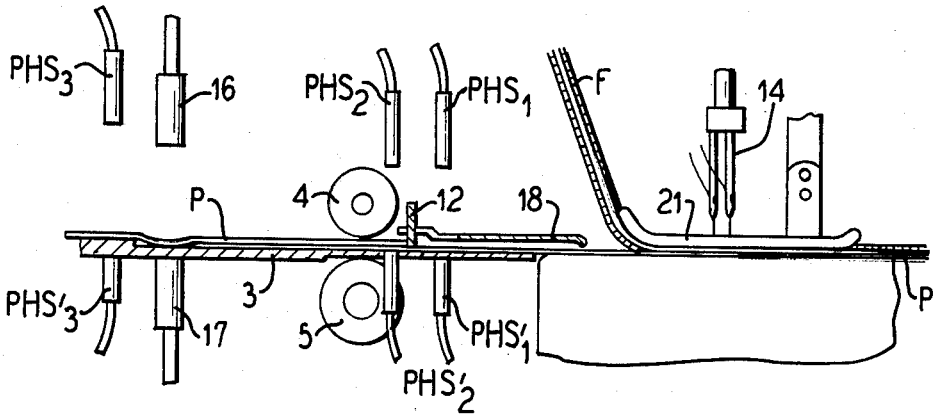
Figure 9D:
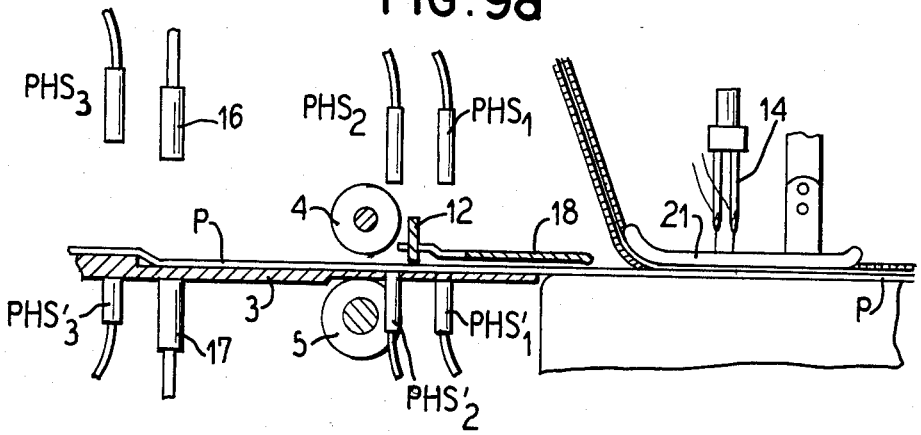
Figure 9E:
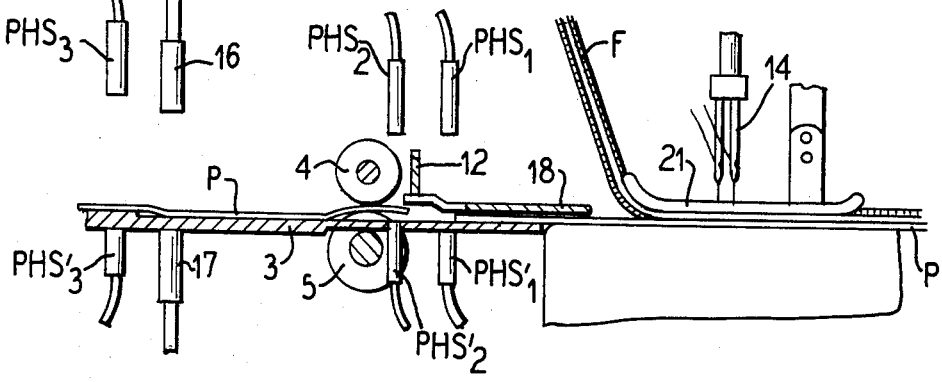
Figure 9F:
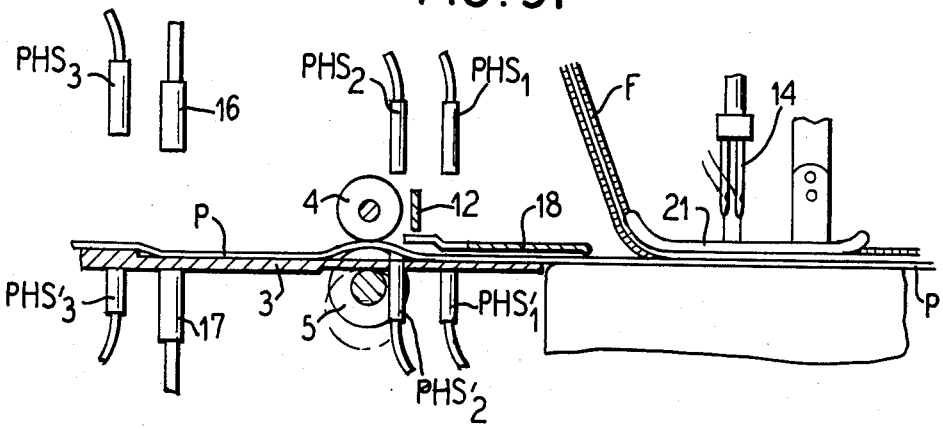

FIGS. *7a* through *7c* are schematic cross-sectional views, with parts omitted, of the inventive apparatus, illustrating the initial stage of the sewing of a succession of fly strips;

FIG. 8 is a schematic cross-sectional of a modified arrangement to FIG. *7a*;

FIGS. *9a* through *9f* are schematic cross-sectional views illustrating a cycle of operation of the inventive apparatus (FIGS. *9d–9f* being repetitous of FIGS. *7a–7c*, respectively); and FIG. 10 is schematic cross-sectional view illustrating the final stage of the sewing of a succession of fly strips.

DESCRIPTION OF THE PREFERRED EMBODIMENTS

Figure 2:
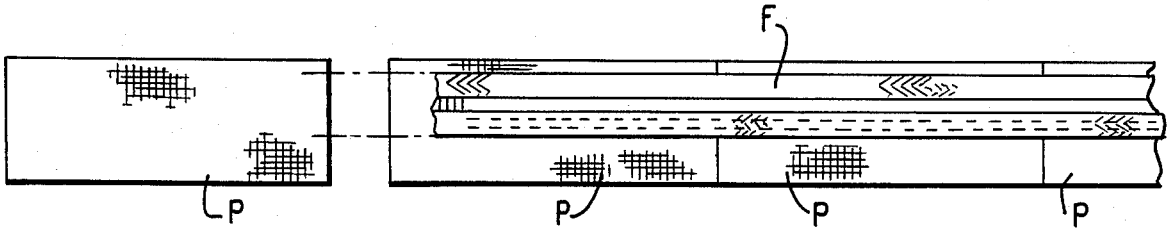
FIG. 2 is a fragmentary plan view of a succession of fly strips being sewn to a continuous slide fastener chain.

A purpose of the present invention is to produce a series of fly strips pieces P joined with a continuous length slide fastener chain F at a high rate of production, not heretofore possible, using a continuously operating sewing machine. The end result of the invention is shown in FIG. 2 which depicts continuously sewn together fly strips and fastener chain with the fly strip pieces P disposed together in end-to-end relation.

Figure 1:
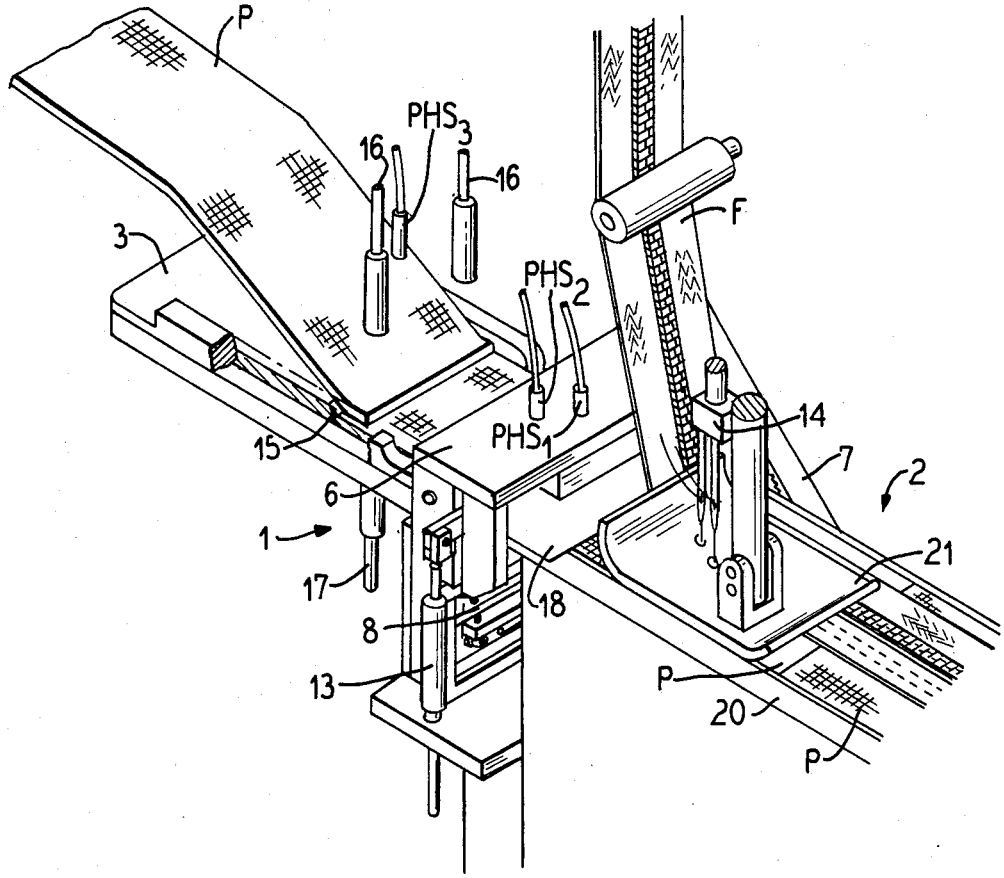
FIG. 1 is a perspective view, with parts broken away, of a fly-strip attaching apparatus embodying the present invention.
Figure 3:
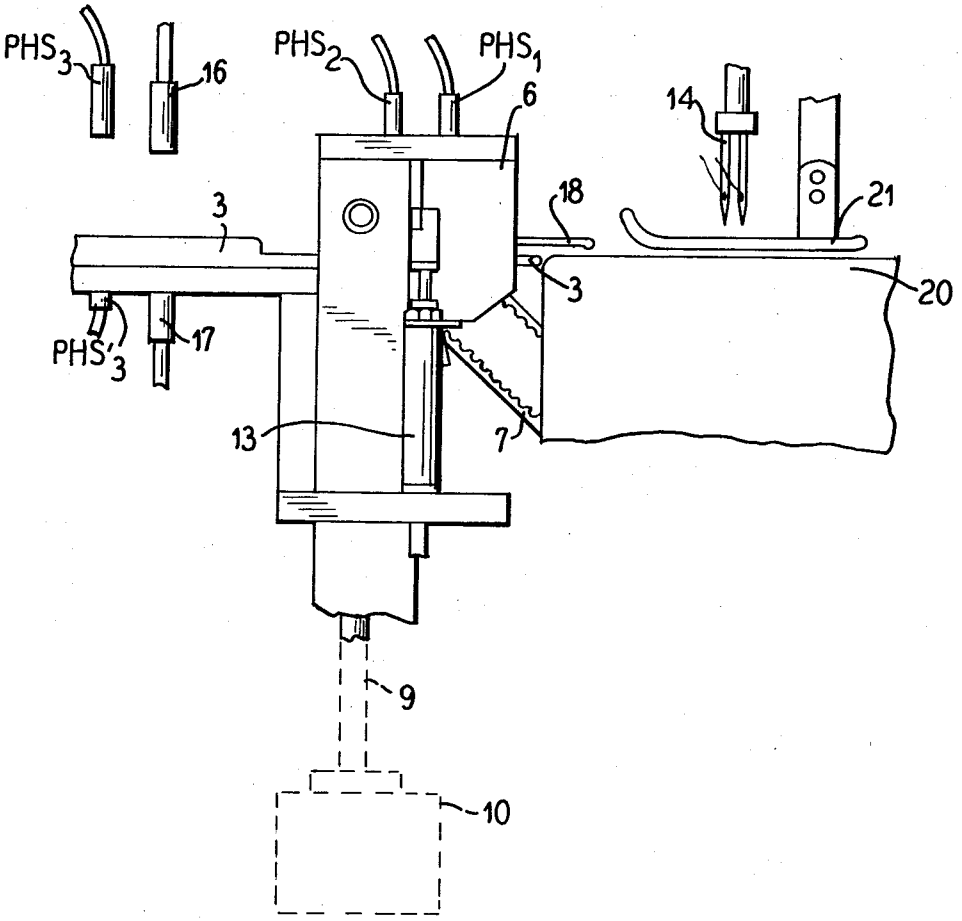
FIG. 3 is a side elevational view, with parts omitted or broken away, of the apparatus of FIG. 1.

FIGS. 1 and 3 show an automatic apparatus for attaching a succession of fly strips P to the continuous slide fastener chain F continuously without interruption in accordance with the present invention. The apparatus generally comprises a conventional-type sewing machine 2 and a fly-strip feed station 1 for automatically supplying the successive fly strips P continuously to the sewing machine 2.

The sewing machine 2 may be a conventional type on the market. It includes a support table 20 for supporting thereon the fly strip P to be sewn, a pressure foot 21, and a pair of needles 14 for sewing the fly strips P to the fastener chain F. The fastener chain F is continuously supplied from a non-illustrated reel, supported on an upper portion of the sewing machine 2, to the sewing machine station through the space between the support table 20 and the pressure foot 21. The details of the sewing machine 2 itself are not pertinent here and its detailed description is omitted for clarity.

To start the sewing operation, a lead one of the successive fly strips P may be placed by hand on a lower guide 3 extending upstream of the feed station 1 and then introduced by hand into the feed station 1 along the lower guide 3. This thus introduced lead fly strip P is supplied by means of a driven feed roll means to the sewing machine 2 where the fly strip P is sewn to the fastener chain F.

Figure 4:
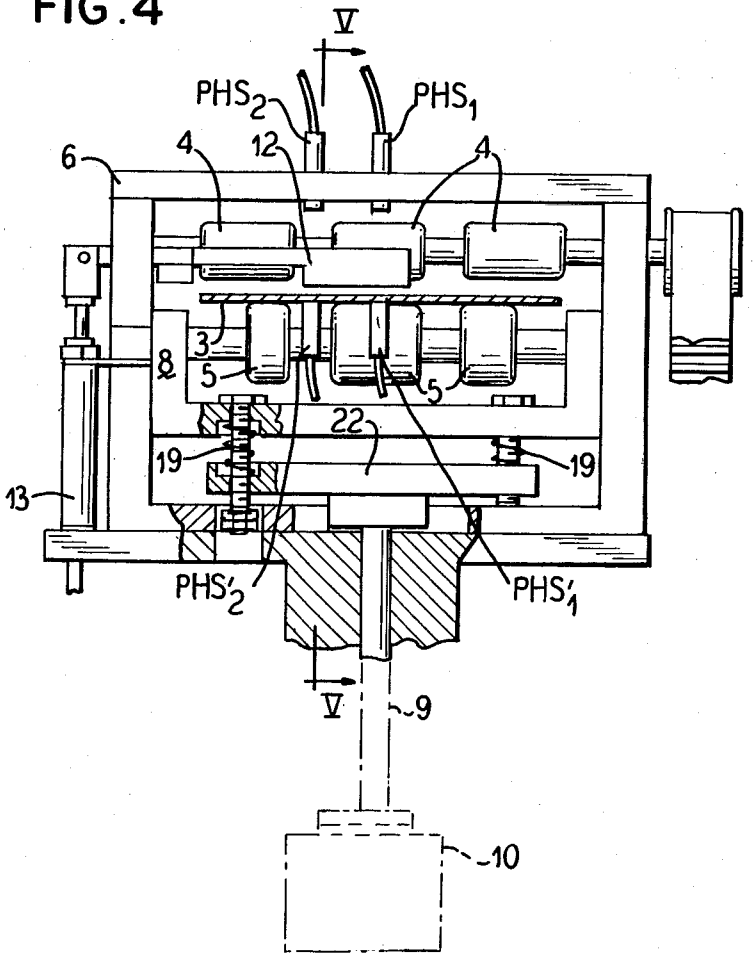
FIG. 4 is a front elevational view, with parts omitted or broken away, of a fly-strip feed station of the apparatus of FIG. 1.
Figure 6:
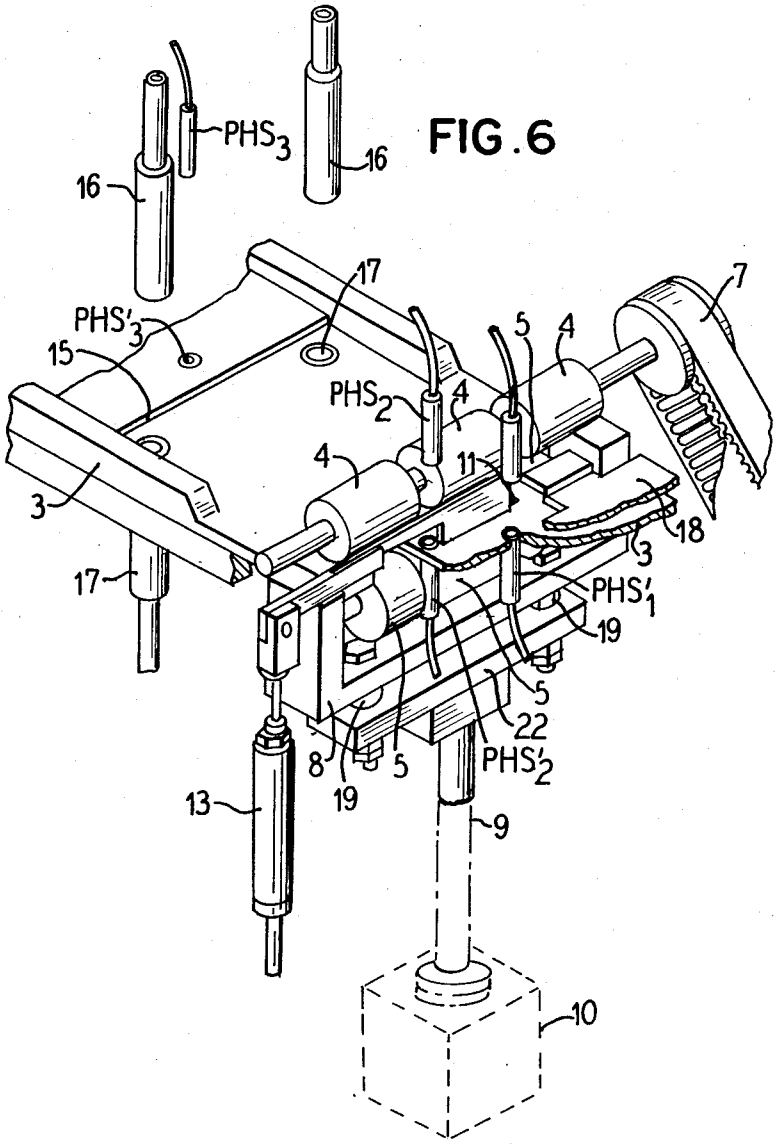
FIG. 6 is a perspective view, with parts broken away, of the fly-strip feed station of FIG. 4.
Figure 5:
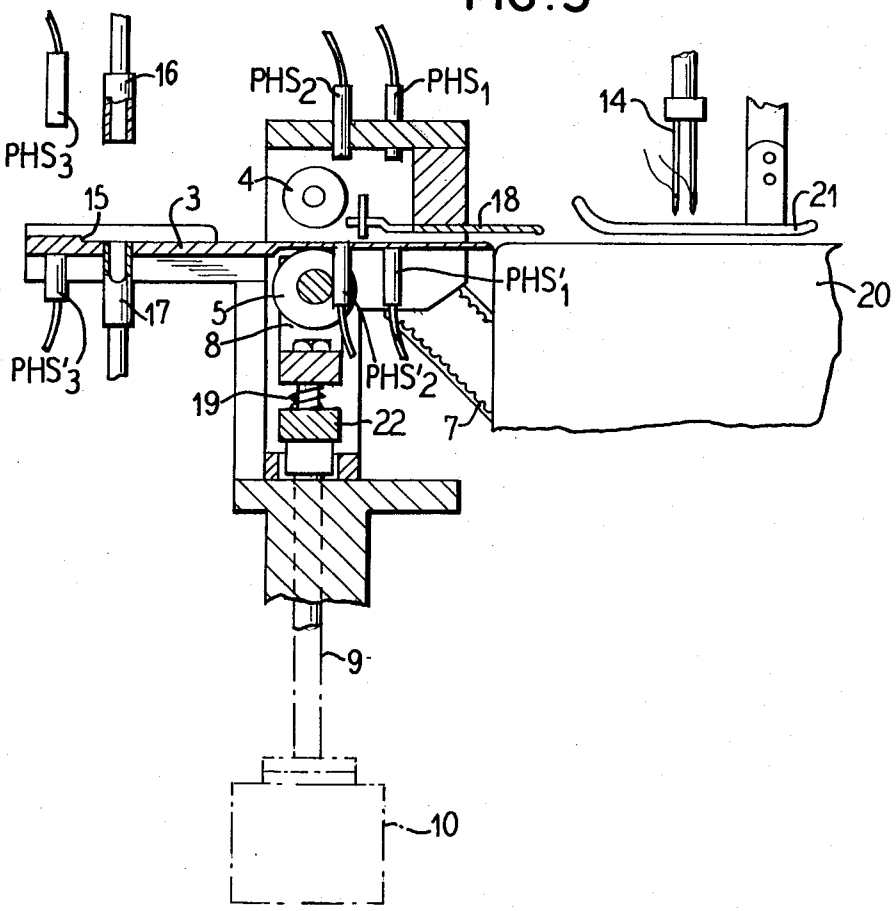
FIG. 5 is a cross-sectional view taken along line V—V of FIG. 4, with a sewing station partially shown.
Figure 7A:
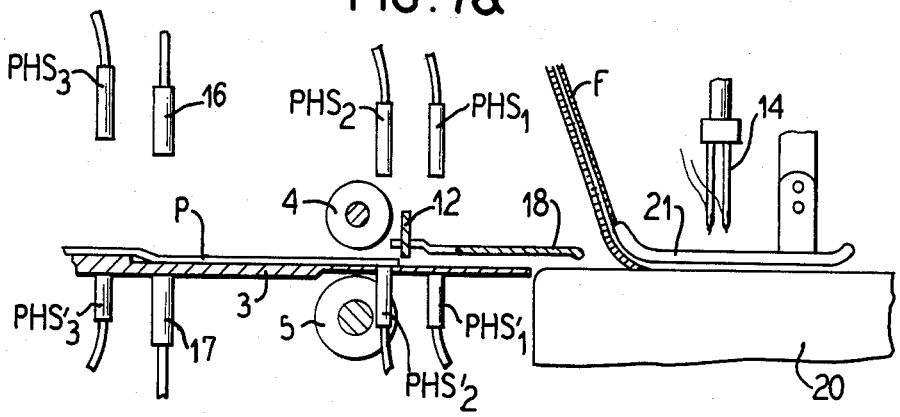
Figure 7B:
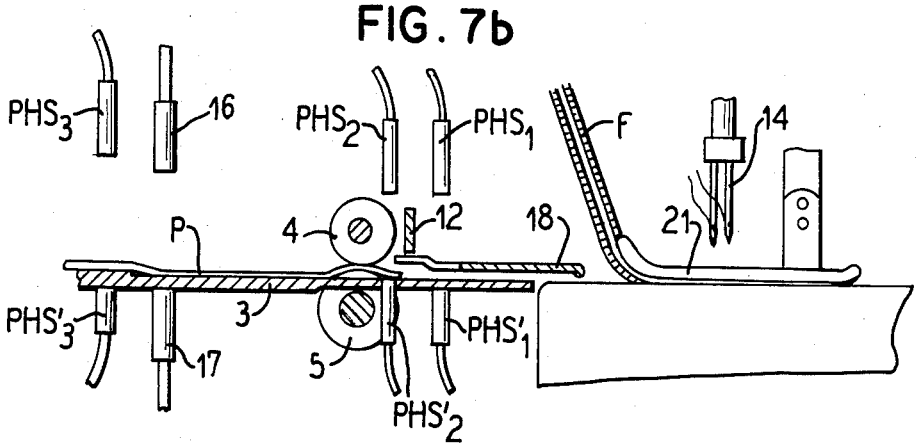
Figure 7C:
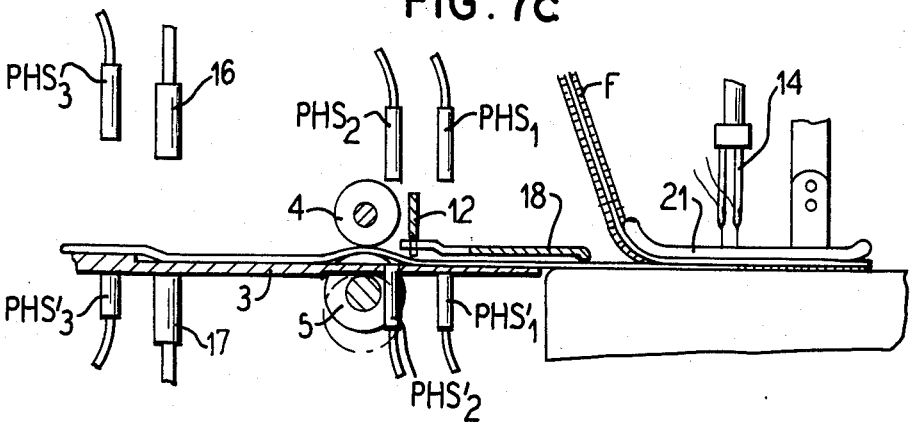

With further reference to FIGS. 4–6, the feed station 1 includes driven rollers 4 and coaction pressure rollers 5, both mounted within a rectangular frame 6 in vertically opposed relationship, to comprise the feed roll means. A common shaft supports the driven rollers 4 and this shaft is driven counterclockwise as viewed in FIG. 5 by a suitable drive source (not shown) of the sewing machine 2 via an endless timing belt 7. The pressure rollers 5 serves to press the individual fly strip P against the driven rollers 4, thereby feeding the fly strip P toward the sewing machine 2. The feeding rate of the fly strip P by the roll means 4, 5 is higher than the rate at which the fly strip P is sewn to the fastener chain F by the sewing machine 2, for reasons described below.

A common shaft supports the pressure rollers 5 and this shaft rotatably supported by an upwardly opening C-shaped bracket 8. The bracket 8 is operatively connected to a piston-cylinder lift device having an air cylinder 10 and a piston rod 9 having a piston disposed in the air cylinder 10. The bracked 8 is vertically movable in response to energization of the air cylinder 10. In response to this vertical movement of the bracket 8, the pressure rollers 5 are vertically movable to project through and retract from openings 11 in the lower guide 3, thereby bringing the fly strip P toward or away from the driven rollers 4.

Disposed adjacent and downstream of the drive rollers 4 is a fly strip stop 12 operatively via a lever action to another piston-cylinder lift having an air cylinder 13 mounted on one side of the frame 6. The stop 12 is vertically movable toward away from the lower guide 3 in response to energization of the air cylinder 13. In its lowered position, the stop 12 is spaced apart from the upper surface of the lower guide 3 by a gap of a predetermined distance so as to allow only a single fly strip P to pass through the gap. In this position the stop will not allow two superimposed fly strips to pass through the gap.

A pair of photoelectric cells $PHS'_1$ and $PHS'_2$ is supported on the lower guide 3 for receiving light from a pair of light sources $PHS_1$ and $PHS_2$, respectively, supported on the top of the frame 6. The photoelectric cell $PHS'_1$ and the light source $PHS_1$ are disposed adjacent and downstream of the stop 12 and are operative, in the absence of any fly strip P between the light source $PHS_1$ and the photoelectric cell $PHS'_1$, to energize the two air cylinders 10 and 13 so as to bring up the pressure rollers 5 and the stop 12.

The light source $PHS_2$ and the photoelectric cell $PHS'_2$ are disposed between the stop 12 and the driven rollers 4 and are operative, in the absence of any fly strip P between the light source $PHS_2$ and the photoelectric cell $PHS'_2$, to deenergize the sewing machine 2 and the reciprocating movements of the sewing needles 14. For reasons described below, even assuming that a fly strip P is inserted between the light source $PHS_2$ and the photoelectric cell $PHS'_2$ after this detector has detected the absence of any fly strip P therebetween, the sewing machine 2 is kept inoperative unless a suitable start switch, such as a foot switch (not shown), is energized.

As shown particularly in FIGS. 1, 5 and 6, the lower guide 3 has a downward step 15, the height of which being substantially equal to the thickness of a single fly strip P. A pair of laterally spaced suction pipes 17 is supported by a lower guide 3 and opens upwardly from the lower level surface of the lower guide 3 immediately downstream of the step 15 for drawing air thereto. A pair of blow pipes 16 is disposed directly above the suction pipes 17, respectively, in confronting relationships for issuing pressure air jets. A photoelectric cells $PHS'_3$ is supported by the upper level portion of the lower guide 3 immediately upstream of the step 15 for receiving light from a light source $PHS_3$ disposed above the photoelectric cell $PHS'_3$ in confronting relationship. The photoelectric cell $PHS'_3$ and the light source $PHS_3$ are operatively connected to the blow pipes 16 and the suction pipes 17 to energize the same. In the absence of any fly strip P between the light source $PHS_3$ and the photoelectric cell $PHS'_3$, the blow pipes 16 are energized to blow out pressurized air jets while, on the other hand, the suction pipes 17 are energized to draw in air above the lower guide 3, forcing the preceding fly strip P against the upper surface of the lower guide 3 adjacent the step 15. Accordingly, a succeeding fly strip P can be easily inserted into the feed station 1 without engagement with the trailing end of a preceding fly strip P, since the trailing end of the preceding fly strip P is held by the pressure differential against the lower, stepped-down surface of the guide 3.

An upper guide 18 is disposed on the frame 6 substantially parallel to the downstream end portion of the lower guide 3 for guiding and directing the individual fly strip P to the sewing machine 2. A pair of compression springs 19 are mounted between an auxiliary plate 22 supported by the free end of the piston rod 9 and the bracket 8 to absorb any undue pressure of the pressure rollers 5 against the driven rollers 4. This resilient mounting prevents any damage to the fly strip P and also allows the individual fly strip P to pass between the driven rollers 4 and the pressure rollers 5, regardless of the thickness of the fly strip.

The pressure rollers 5 and the stop 12 (which have been raised upon energization of the two air cylinders 13 and 10 by the action of the light source $PHS_1$ and the photoelectric cell $PHS'_1$) will automatically return to their original and lowered position when the fly strip P arrives at the sewing station, that is, when the fly strip's leading end is just below the sewing needles 14. This automatic return of the pressure rollers 5 and the stop 12 may be controlled in various known manners. For example, such a control may include a measuring roller for producing signal pluses as many as the number of revolutions of the pressure rollers 5, and a counter for counting the number of the signal pulses issued by the measuring roller and for producing a "return" signal when the number of the counted signal pulses reaches a predetermined value which corresponds to the distance between the stop 12 and the sewing station, i.e. the sewing needles 14. In an alternative form, a detector may be disposed at the sewing station for detecting the arrival of the fly strip's leading end and for producing the "return" signal upon that detection. Further, a timer may be used to produce a "return" signal after a lapse of a predetermined time during which the fly strip's leading end travels from the stop 12 to the sewing station.

In the illustrated embodiment, the pressure rollers 5 are disposed below the lower guide 3, while the driven rollers 4 are disposed above the lower guide 3. However, the pressure rollers 5 may be disposed above the lower guide 3, and the driven rollers 4 disposed below the lower guide 3, if desired.

Further, the vertical movements of the pressure rollers 5 and the stop 12 may be brought about by other suitable means, such as solenoid-operated plungers, rather than air cylinders, Operation of the inventive fly-strip attaching apparatus will now be described. Before the start of the attaching work for a succession of fly strips P, i.e. before the first or foremost fly strip P is supplied to the apparatus, the pressure rollers 5 and the stop 12 are in their lowered positions as shwon in FIG. 5.

First, as shown in FIG. *7a*, the fastener chain F is manually introduced into the sewing station through the space between the support table 20 and the pressure foot 21 until the leading end of the fastener chain F is substantially vertically aligned with the sewing needles 14. The foremost fly strip P is placed on the lower guide 3 (such as manually) and is then introduced therealong into the feed station 1 through the space between the opposed driven and pressure rollers 4 and 5 until the leading end of the fly strip P reaches immediately behind the stop 12. The operation of the apparatus will be started by pressing a suitable start switch, such as a foot switch (not shown), which is operatively connected not only to the drive source of the sewing machine 2 but also to the control for vertical movements of the pressure rollers 5 and the stop 12.

As the apparatus 1 is started, the needles 14 begin to move up and down through only the fastener chain F and the pressure rollers 5 and the stop 12 are raised, as shown in FIG. *7b*, to feed the foremost fly strip P to the sewing station, introducing the leading end of the fly strip P under the fastener chain F until that leading end reaches just below the sewing needles 14. Upon arrival of the foremost fly strip P at the sewing station, the pressure rollers 5 and the stop 12 return to the original or lowered position as indicated by dash-and-two-dot lines in FIG. *7c*, since then the sewing of the foremost fly strip P takes place.

In an alternative manner, as illustrated in FIG. 8, prior to the start of the apparatus, the fastener chain F is manually introduced into the sewing station as described above in connection with FIG. *7a*; but the foremost fly strip P is manually introduced the foremost fly strip P through the feed station 1 into the sewing station until the fly strip's leading end lies under the fastener chain's leading end in an alignment therewith. At that time the pressure rollers 5 and the stop 12 are kept in lowered position until the non-illustrated start switch is pressed to start the sewing machine 2.

The purpose of possibly using a foot switch to start the sewing operation of the apparatus is to secure safety of the operator. If the sewing operation were automatically started during the manual insertion of the foremost fly strip P into the feed station 1, there could be a danger that the operator's hand as well as the fly strip P would be injured or damaged due to sudden rotation of the driven rollers 4.

As shown in FIG. *9a*, when the trailing end of the preceding fly strip P has passed across the light path between the light source $PHS_3$ and the photoelectric cell $PHS'_3$ as the sewing progresses, the blow pipes 16 blow air jets onto the preceding fly strip and the suction pipes 17 draw air under this fly strip P, thus forcing that strip's trailing end against the lower level surface of the lower guide 3, as shown in FIG. *9b*. Accordingly, the succeeding fly strip P can be easily introduced into the feed station 1 over the top of the preceding fly strip P until the leading end of the succeeding fly strip P reaches the lowered stop 12 without hitting the trailing end of the preceding fly strip P, as shown in FIGS. *9b* and *9c*.

Because the gap distance between the lower level surface of the lower guide 3 and the lowered stop 12 is slightly larger than the thickness of a single fly strip P but smaller than twice that thickness, the succeeding fly strip P is not allowed to move forward beyond the stop 12 until the trailing end of the preceding fly strip P passes the light path between the light source $PHS_1$ and the photoelectric cell $PHS'_1$ as the sewing of the preceding fly strip P progresses, as shown in FIG. *9d*.

Upon detection of the trailing end of the preceding fly strip P by the light source $PHS_1$ and the photoelectric cell $PHS'_1$, the pressure rollers 5 and the stop 12 are raised to supply the succeeding fly strip P toward the sewing station, as shown in FIG. *9e*. By that time the preceding fly strip's trailing end is spaced apart and advanced from the succeeding fly strip's leading end, because the stop 12 is disposed before the light path between the light source $PHS_1$ and the photoelectric cell $PHS'_1$ by some distance. However, the leading end of the succeeding fly strip P catches up with the preceding fly strip's trailing end by the time the latter arrives at the sewing station, as shown in FIG. *9f*, since the feeding speed of the succeeding fly strip P by the driven and pressure rollers 4, 5 is higher than the sewing speed of the preceding fly strip P. Thus the individual successive fly strips P are cuased to be sewn to the continuous fastener chain F continuously with opposed ends of adjacent fly strips abutting each other, as shown in FIG. 2.

As shown in FIG. 10, when the trailing end of the final fly strip P to be sewn has passed across the light path between the light source $PHS_2$ and the photoelectric cell $PHS'_2$, this detector produced a "stop" signal to terminate the operation of the sewing machine 2, leaving the trailing portion of the final fly strip P located between the stop 12 and the sewing station without being sewn. To finish the sewing of the final fly strip P, the sewing machine 2 is restarted by pressing the non-illustrated start switch.

With the arrangement according to the present invention, it is possible to sew successive fly strips to the fastener chain continuously and efficiently since the succeeding fly strip is placed over the preceding fly strip in the feed station and then supplied to the sewing station immediately contiguously following the preceding fly strip, such that the sewing machine can be continuously usefully operating.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for automatically feeding successive individual pieces to a continuously operating sewing machine for sewing, comprising a sewing machine, means for commencing sewing of a preceding piece in said sewing machine, means for supporting a leading end of a succeeding piece in superimposed relation over a trailing end of said preceding piece being sewn, a stop upstream of said sewing machine for keeping said succeeding piece waiting for supply to said sewing machine, feed roll means for supplying said succeeding piece to said sewing machine for sewing, and a detector for detecting when the trailing end of said preceding piece advances out from under the leading end of said succeeding piece and then engaging means for releasing said stop and energizing said feed roll means to supply said succeeding piece to said sewing machine for sewing.

2. The apparatus of claim 1, wherein said feed roll means supplies said succeeding piece at a speed higher than the rate at which sewing of said preceding piece progresses such that the leading end of said succeeding piece abuts the trailing end of said preceding piece when said succeeding piece commences being sewn.

3. The apparatus of claim 1, wherein said stop is a movable abutment disposed between said feed roll means and said sewing machine and beneath which the trailing end of said preceding piece advances to said sewing machine.

4. The apparatus of claim 1, further comprising means for exerting pressure on the trailing end of said preceding piece being sewn to keep said preceding piece trailing end beneath and out of interference with the leading end of said succeeding piece being superimposed.

5. The apparatus of claim 1, further comprising means for continuously delivering a continuous length material to said sewing machine for being sewn onto said successive pieces.

6. The apparatus of claim 5, wherein said successive pieces are fly strips and said continuous length material is slide fastener chain.

7. Apparatus for automatically attaching successive fly strips to a continuous length slide fastener chain, comprising a sewing machine, means for feeding the slide fastener chain to said sewing machine, and a feed station for supplying the fly strips one after another along a substantially horizontal path to said sewing machine, said feed station having a guide for directing the fly strips to said sewing machine, a pair of feed rollers disposed at opposite sides of said guide for feeding the fly strips along said guide to said sewing machine, a vertically movable stop, disposed above said guide between said feed rollers and sewing machine, for keeping a succeeding fly strip waiting and superimposed over a preceding fly strip being sewn, a detector disposed between said stop and sewing machine for detecting when the trailing end of said preceding fly strip advances out from beneath the leading end of said succeeding fly strip, and means operable in response to detection by said detector for engaging said feed rollers and releasing said stop to cause said succeeding fly strip to be passed to said sewing machine for sewing.

8. The apparatus of claim 7, wherein said feed rollers are driven so as to feed said succeeding fly strip toward said sewing machine at a speed higher than the rate at which the sewing of the preceding fly strip by said sewing machine progresses.

9. The apparatus of claim 8, wherein one of said feed rollers is fixed and the other feed roller is disposed for vertical movement toward and away from said one feed roller to respectively engage and disengage said succeeding fly strip for passage to said sewing machine.

10. The apparatus of claim 7, wherein said stop is spaced above said guide in its lowered position by a gap distance substantially equal to the thickness of only a single fly strip and said preceding strip being sewn passes through said gap when said stop is in its lowered position.

11. The apparatus of claim 7, wherein said detector comprises a light source disposed above said guide and a photoelectric cell for receiving light from said light source to produce a detection.

12. The apparatus of claim 7 further comprising a further detector disposed between said feed rollers and said stop for detecting when a trailing end of a final fly strip passes said further detector and means operable in response to detection by said further detector to shut off said sewing machine.

13. The apparatus of claim 12, wherein said further detector comprises a second light source disposed above said guide and a second photoelectric cell for receiving light from said second light source to produce a detection signal.

14. The apparatus of claim 7, wherein said guide has a pair of lower and higher level portions divided by a transverse step, said lower level portion being disposed upstream of and beneath said stop, the height of said step being substantially equal to the thickness of only a single fly strip.

15. The apparatus of claim 14, comprising a further detector disposed adjacent said step for detecting when the trailing end of said preceding fly strip passes said further detector, and means disposed near and downstream of said step and operable in response to said detection of said further detector for forcing the trailing end of said preceding fly strip against said lower level portion of said guide.

16. The apparatus of claim 15, wherein said means operable in response to said further detector comprises a blow pipe means disposed above said lower level portion of said guide for selectively issuing a pressurized flow against the upper surface of said preceding fly strip and a suction pipe means supported by said guide directly beneath said blow pipe means for drawing air under said preceding fly strip.

17. The apparatus of claim 9, further comprising a bracket supporting said other feed rolller and moving means connected to said bracket and said stop for vertical movement of said other feed roller and said stop in response to detection by said detector.

18. The apparatus of claim 17, further comprising a resilient means disposed between said bracket and said moving means, such that said other feed roller resiliently engages against said one feed roller.

* * * * *